US006266632B1

(12) United States Patent
Kato et al.

(10) Patent No.: US 6,266,632 B1
(45) Date of Patent: Jul. 24, 2001

(54) SPEECH DECODING APPARATUS AND SPEECH DECODING METHOD USING ENERGY OF EXCITATION PARAMETER

(75) Inventors: Kiminori Kato, Urawa; Motoyasu Ohno, Ohyaguchikita-machi, both of (JP)

(73) Assignee: Matsushita Graphic Communication Systems, Inc., Tokyo (JP)

( * ) Notice: Subject to any disclaimer, the term of this patent is extended or adjusted under 35 U.S.C. 154(b) by 0 days.

(21) Appl. No.: 09/267,685

(22) Filed: Mar. 15, 1999

(30) Foreign Application Priority Data

Mar. 16, 1998 (JP) ..... 10-088175

(51) Int. Cl.[7] ..... G10L 21/00; G10L 19/04

(52) U.S. Cl. ..... 704/219; 704/220; 704/225; 704/226

(58) Field of Search ..... 704/219, 220, 704/225, 226

(56) References Cited

FOREIGN PATENT DOCUMENTS

| | | |
|---|---|---|
| 1-186042 | 7/1989 | (JP) . |
| 7-177085 | 7/1995 | (JP) . |
| 8-320700 | 3/1996 | (JP) . |
| 9-185396 | 7/1997 | (JP) . |

OTHER PUBLICATIONS

"General Aspects of Digital Transmission Systems: Dual Rate Speech Coder for Multimedia Communications Transmitting at 5.3 and 6.3 kbit/s", ITU–T Recommendation G.723.1, 1996.

Notice of Reason for Rejection issued on May 11, 1999 of Japanese Patent Application No. H10–88175.

English language abstract of JP 8–320700.

English language abstract of JP 1–186042.

English language abstract of JP 7–177085.

English language abstract of JP 9–185396.

Notice of Reason for Rejection issued on Oct. 26, 1999 of Japanese Patent Application No. H10–88175.

*Primary Examiner*—Richemond Dorvil
*Assistant Examiner*—Susan McFadden
(74) *Attorney, Agent, or Firm*—Greenblum & Bernstein, P.L.C.

(57) ABSTRACT

The speech decoding apparatus decodes a speech signal that is coded into a plurality of speech parameters including an excitation parameter, using the excitation parameter. The controller controls an output speech volume of the decoded speech signal according to a predetermined gain parameter. At this point, the gain parameter is corrected according to an energy of the speech signal corresponding to the excitation parameter. The controller controls the output speech volume corresponding to the gain parameter only when the energy of the speech signal corresponding to the excitation parameter is within a predetermined range.

17 Claims, 10 Drawing Sheets

SPEECH DECODING APPARATUS AND SPEECH DECODING METHOD USING ENERGY OF EXCITATION PARAMETER

BACKGROUND OF THE INVENTION

1. Field of the Invention

The present invention relates to a speech decoding apparatus and speech decoding method for decoding digital speech data coded based on excitation parameter information in accordance with ITU-T Recommendation G.723.1 and CELP (Coded Excited Linear Prediction) coding.

2. Related Art

One of the Recommendations concerning speech coding technique is ITU-T Recommendation G.723.1, which recommends about speech codec of ITU-T Recommendation H.324 concerning videophone using primarily analogue lines. In this speech coding technique, speech signals are coded at dual rates of 6.3 kbps and 5.3 kbps to represent human vocal mechanism.

A conventional coding apparatus is explained below with reference to a function block diagram in FIG. 1.

In a coding section, a speech signal is input to LPC analysis section 1101 and perceptual weighting filter 1102. LPC analysis section 1101 executes linear prediction of the speech signal to represent human voice path (throat form). LSP quantizer 1104 quantizes a linear predicted result to obtain LSP information that is one of speech parameters.

On the other hand, perceptual weighting filter 1102 modifies a frequency characteristic of speech signal to improve perception. Pitch estimator 1103 computes a pitch of the speech signal passed through the filter 1102. Harmonic noise shaping filter 1105 adjusts a distortion of the speech signal so that a noise or the like that contained in the perceptual weighted speech signal processed in the filter 1102 is under the threshold. In other words, the filter 1105 adjusts a speech quality. Pitch predictor 1106 obtains the returned speech data previously processed in pitch predictor 1106. Pitch predictor 1106 computes a pitch of current speech signal using the previously processed speech data to generate pitch information (pitch length and index to determine voiced sound or voiceless sound) Based on the generated pitch information, excitation parameter generator 1107 generates an exited signal to output to pseudo decoder 1108. Excitation parameter generator 1107 computes energy of the exited signal as an excitation parameter (Mamp), anddetermines an index in which the exited signal is coded according to the excitation parameter (Mamp). Excitation parameter generator 1107 has a index table which is correspondingly registered index number and excitation parameter (Mamp). Pseudo decoder 1108 once decodes the index to obtain the exited signal and returns the exited signal to pitch predictor 1106 for pitch prediction of following speech data.

As described above, in the coding in accordance with ITU-T Recommendation G723.1, LSP information, pitch information and excitation parameter information (index) are generated and transmitted from a transmitting side to a receiving side via a line. The receiving side decodes the information received from the transmitting side to reproduce the speech signal.

In the decoder, the LSP information is input to LSP decoder 1121, the pitch information is input to pitch decoder 1122, and the excitation parameter information is input to excitation parameter decoder 1123. Synthesis filter 1124 is constructed with coefficient corresponding to the decoded LSP information. A signal synthesized from the pitch data decoded in pitch decoder 1122 and an excited signal decoded by excitation decoder 1123 is input to synthesis filter 1124. The speech signal synthesized in synthesis filter 1124 is subjected to a correction in perceptual weighting filter 1125 to improve perception.

As described above, in ITU-T Recommendation G723.1, speech signal is divided into a plurality of parameters for coding, while the speech signal is decoded based on these plurality of parameters.

This coding method is a kind of CELP (Code Excited Linear Prediction) coding. The coding in CELP has characteristics of both the coding in which a generation process of speech is coded and the waveform coding, in which the excitation parameter is generated in the same way as the coding in accordance with ITU-T Recommendation G723.1.

In the speech coding in accordance with ITU-T Recommendation G723.1, a speech volume difference occurs between at a receiving side and a transmitting side by a line deterioration or others in communicating a speech through a telephone line or the like. In other words, since a speech at one side is recorded higher while another speech at another side is recorded lower, the speeches coded then decoded become hard to listen.

The above problem is caused by a volume difference between original speeches. A control of a gain of low volume speech is expected to prevent the problem to be caused. As the gain control, the following methods are considered.

A speech signal existing together with high volume and low volume are reproduced as a waveform. The waveform of the speech signal is sampled and energy of each sample is computed. The energy of each sample is subjected to gain control. Specifically, the gain control is performed in order to increase energy of a low volume speech to the same level as a high volume speech while keeping the energy of the high volume speech the same level.

As described above, when a high volume speech and a low volume speech are present, the volume of decoded speech signal is made constant by controlling a gain of the low volume speech signal. It is considered to apply this-method to the case of speech decoding in accordance with ITU-T Recommendation G723.1.

However in this case, the following problems have been remained.

That is, it is necessary to sample a waveform of the reproduced speech signal. It is further necessary to perform this sampling at a high sampling frequency, resulting in a large number of samplings. Therefore, it is necessary to reserve a large memory capacity to save sampled data and a large amount of computations are required to process a large amount of sampled data for the gain control, resulting in a heavy load of a CPU and a low decoding rate.

SUMMARY OF THE INVENTION

It is an object of the present invention to achieve a speech decoding apparatus capable of reducing a computation amount in decoding speeches with different speech volumes that are caused by different talkers so as to reproduce a speech easy to listen when the speech data that is coded in accordance with ITU-T Recommendation G723.1 is decoded, especially a speech recording is performed.

The speech decoding apparatus of the present invention comprises a decoding function for decoding a speech signal that is coded into a plurality of speech parameters, and a correction function for correcting a speech based on the energy value computed based on an excitation parameter that is one of the plurality of parameters and a predetermined gain parameter.

According to the speech decoding apparatus of the present invention, it is possible to obtain a pleasant to listen-to speech by correcting the speech coded based on the energy value computed based on the excitation parameter and the predetermined gain parameter.

In addition, the speech decoding apparatus of the present invention corrects the speech using a gain parameter when the energy computed based on an excitation parameter is within a predetermined range.

According to the speech decoding apparatus, it is possible to obtain a pleasant to listen-to speech without correcting noise and without causing an overflow due to a large volume speech because the apparatus corrects the speech when the excitation energy is within the predetermined range.

In addition, the speech decoding apparatus of the present invention corrects speech data for every subframe, and increases or decreases a gain parameter so that the gain parameter approximately becomes a target value that is arbitrary set within the predetermined range every time the correction is performed. It is thereby possible to correct the decoded speech on a subframe-by-subframe basis and obtain a speech easy to listen and having no sense of incongruity by correcting gradually.

In addition, the speech decoding apparatus of the present invention makes the target value a smaller value when a sound having a predetermined periodicity is detected. It is thereby possible, when the sound having the predetermined periodicity, i.e., PB tone or a single frequency speech is detected, to perform correction processing appropriate for the sound not to cause the over flow.

In addition, the speech decoding apparatus of the present invention makes a large increment in increasing a gain parameter, while makes a small decrement in decreasing the gain parameter. Accordingly, since the speech volume is increased rapidly when increased while decreased gradually when decreased, it is possible to correct the speech with high response and obtain a speech further easy to listen.

In addition, the speech decoding apparatus of the present invention decreases a gain parameter gradually on a subframe-by-subframe basis in order to halt the correction gradually when the correction by a gain control is halted. According to the processing, since the correction degree in the correction processing is decreased gradually, it is possible to neglect the boundary between the corrected data and the uncorrected data, enabling the correction for the speech easy to listen.

In addition, the speech decoding apparatus of the present invention generates an energy value by passing the excitation parameter through an IIR type filter. According to the processing, when the sum of energies of a predetermined plurality of subframes is computed, it is possible to reduce the computation amount and simplify the control.

As an equation for the correction, specifically the equation of (b+a×gain parameter), where a and b are both more than 0, a+b=1 and a is used to decrease the effect on a variation of the gain parameter, is used as a correction coefficient. More specifically, it is appropriate to set a=0.2 so that a affects the gain parameter properly, resulting in b=0.8.

In addition, the speech decoding apparatus of the present invention comprises a noise recognition function for detecting a noise interval or voiceless interval, and does not perform the correction at the noise interval or voiceless interval. According to the processing, since the correction is not performed at the noise interval or voiceless interval, it is possible not correct the noise and to perform the correction for the speech easy to listen.

In addition, the speech decoding apparatus of the present invention comprises a differential value detection function for detecting a differential value between energies of excitation parameters of neighboring subframes, a computing function for computing a sum by adding the detected differential value of a predetermined plurality of previous subframes before an object subframe, another computing function for computing a division value by dividing the sum by a predetermined number, and the other computing function for computing another sum of adding the detected differential value that is less than a predetermined value of over the predetermined plurality of previous subframes before the object subframe, and a function for recognizing a noise interval by detecting the object subframe whose division value is more than the another sum. According to the processing, it is possible to recognize a noise interval when the differential values are smaller than the value obtained by dividing the sum of differential values between excitation energies of neighboring subframes by a predetermined value, because the differential value between neighboring subframes is small at a noise interval.

In addition, the speech decoding apparatus of the present invention decides a shift from a speech interval to a noise interval using a predetermined plurality of subframes, while decides a shift from the noise interval to the speech interval using a subframe. According to the processing, since the shift from the noise interval to the speech interval is determined using a subframe, it is possible to perform the gain control instantly, enabling the correction for the speech easy to listen.

In addition, the speech decoding apparatus of the present invention comprises a recognition function for recognizing a sound with a predetermined periodicity, and a control function for performing a gain control appropriate for a sound with a predetermined periodicity when it is recognized that the sound that is decoded based on the recognition result has the predetermined periodicity. According to the processing, since the low gain control is performed when a single frequency signal or PB tone is detected, it is possible not to generate an extremely high sound, enabling the correction for the speech easy to listen.

In addition, the speech decoding apparatus of the present invention recognizes PB tone or a single frequency signal when a waveform energy in a speech waveform is more than a predetermined value and the energy of the excitation parameter is within a predetermined range. According to the processing, since it is possible to recognize PEB tone or a single frequency signal based on the waveform energy and the energy of the excitation parameter, it is possible to perform the correction for the gain control properly.

In addition, the speech decoding apparatus of the present invention comprises a storage function for storing a plurality of equations indicative of gain parameter characteristics, and changes the characteristic of gain parameter using the equation with a characteristic in which the gain parameter is increased gradually when the decoded speech signal is recognized as PB tone or a single frequency signal, while using the equation with another characteristic in which the gain parameter is increased rapidly when the decoded speech signal is recognized as an ordinary speech. According to the processing, it is possible to control the correction increment or decrement of the gain control properly by changing the characteristic when the decoded speech signal is recognized as PB tone or a single frequency signal, enabling the correction easy to listen.

In addition, the speech decoding apparatus of the present invention comprises an energy computing function for computing an energy of the input speech signal, and a correction function for not performing a gain control when the computed energy is not within a predetermined range, while performing a gain control to correct speech data with a correction amount in which the increment and decrement of the gain control is controlled when the computed energy is within the predetermined range.

According to the speech decoding apparatus, the increment and decrement of the gain control are changed based on the energy value of the speech data on a subframe-by-subframe basis, it is possible to achieve the correction processing for the appropriate gain control.

BRIEF DESCRIPTION OF THE DRAWINGS

The above and other objects and features of the invention will appear more fully hereinafter from a consideration of the following description taken in connection with the accompanying drawing wherein one example is illustrated by way of example.

DESCRIPTION OF THE PREFERRED EMBODIMENT

An embodiment of the present invention is explained below with reference to the accompanying drawings.

Figure 1:
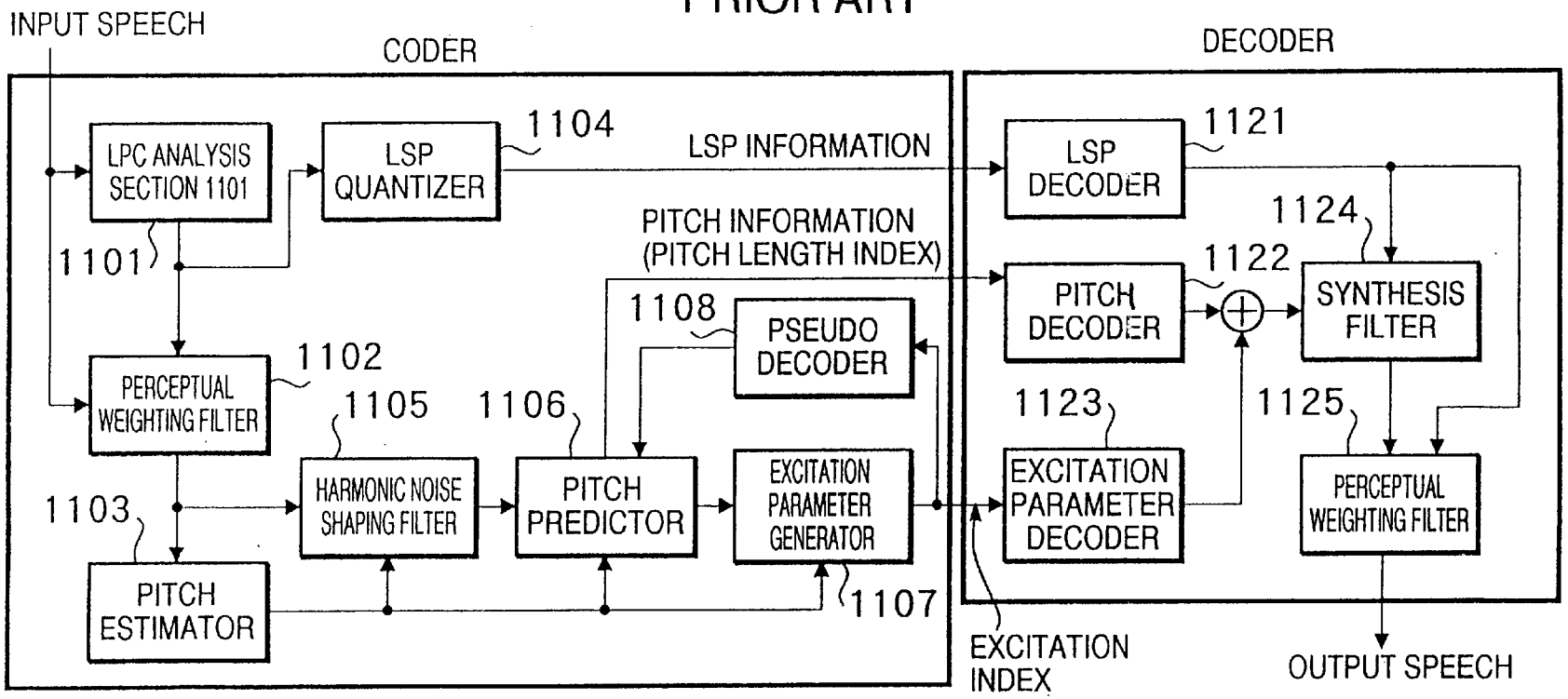
FIG. 1 PRIOR ART
FIG. 1 is a functional block diagram for performing coding and decoding in accordance with ITU-T Recommendation G723.1.
Figure 2:
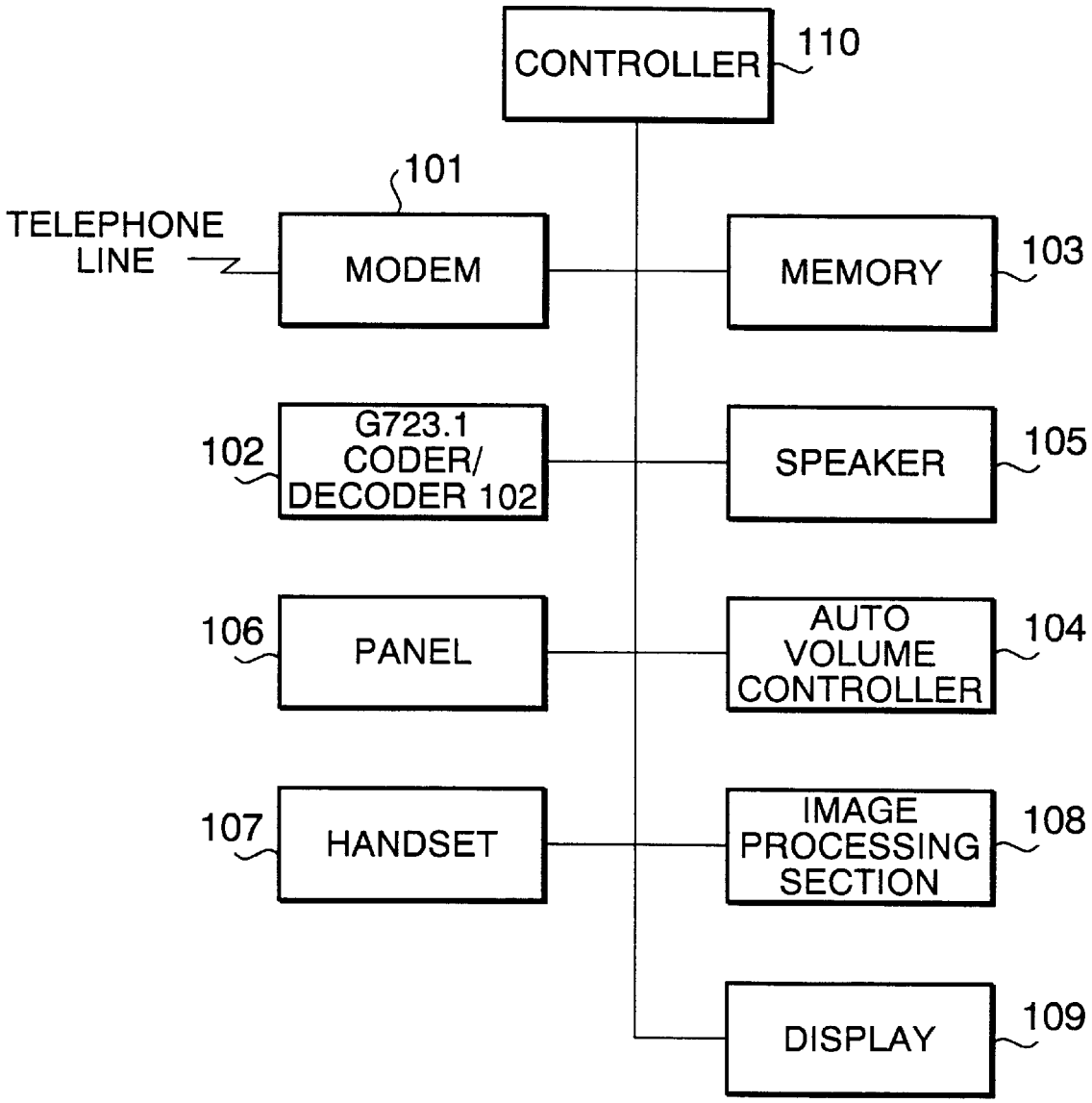
FIG. 2 is a hardware block diagram of a video conference system apparatus using a speech decoding apparatus according to an embodiment of the present invention.

FIG. 2 is a hardware block configuration diagram of a video conference system apparatus using a speech coding/decoding apparatus according to the present invention.

In FIG. 2, modem 101 receives data via a telephone line, and G723.1 coder/decoder 102 performs coding of data received in modem 101 to obtain LSP information, pitch information and excitation parameter information. The LSP information that represent human vocal path is obtained by first performing linear prediction using LPC (Linear Predictive Coding) synthesis then quantization using LSP (Line Spectrum Pair) coefficient. The pitch information corresponds to vibration in human chords and is computed by two steps with open-loop search using perceptual weighted input speech and with closed-loop search to compute a distortion between an input speech and a synthesized speech. The excitation parameter information corresponds to excitation information except for pitch component in human and includes index and gain of five or six excited signals for every sub-frame using impulse response and error signal after the pitch component is removed.

Memory 103 is to store each parameter, and specifically is a digital recordable memory to record a speech signal such as, for example, an IC memory. The input speech signal is coded according to the processing described above.

When the speech signal is decoded, G723.1 decoder section 102 reads the above parameters stored in memory 103 to decode the speech signal. The decoded speech signal is output as a digital speech and input to auto volume controller 104.

Auto volume controller 104 computes an energy (Ener) corresponding to the excitation parameter (Mamp) which is one of the above parameters, using an equation described later. The computation is processed for every subframe so as to allow the computed energy (Ener) to come close to a predetermined value in order to control to gradually increase or decrease a volume of the speech signal. Speaker 105 outputs the voice according to the volume of the speech signal.

Panel 106 is composed of instruction buttons for record or reproduces a speech, a ten-key to call by telephone and others. Handset 107 is to talk and may be replaced with a microphone. Image processing section 108 processes an image transmitted from the external through modem 101. Display 109 displays the image processed in image processing section 108. Controller 110 controls over entire section of modem 101 through display 109.

Figure 3:
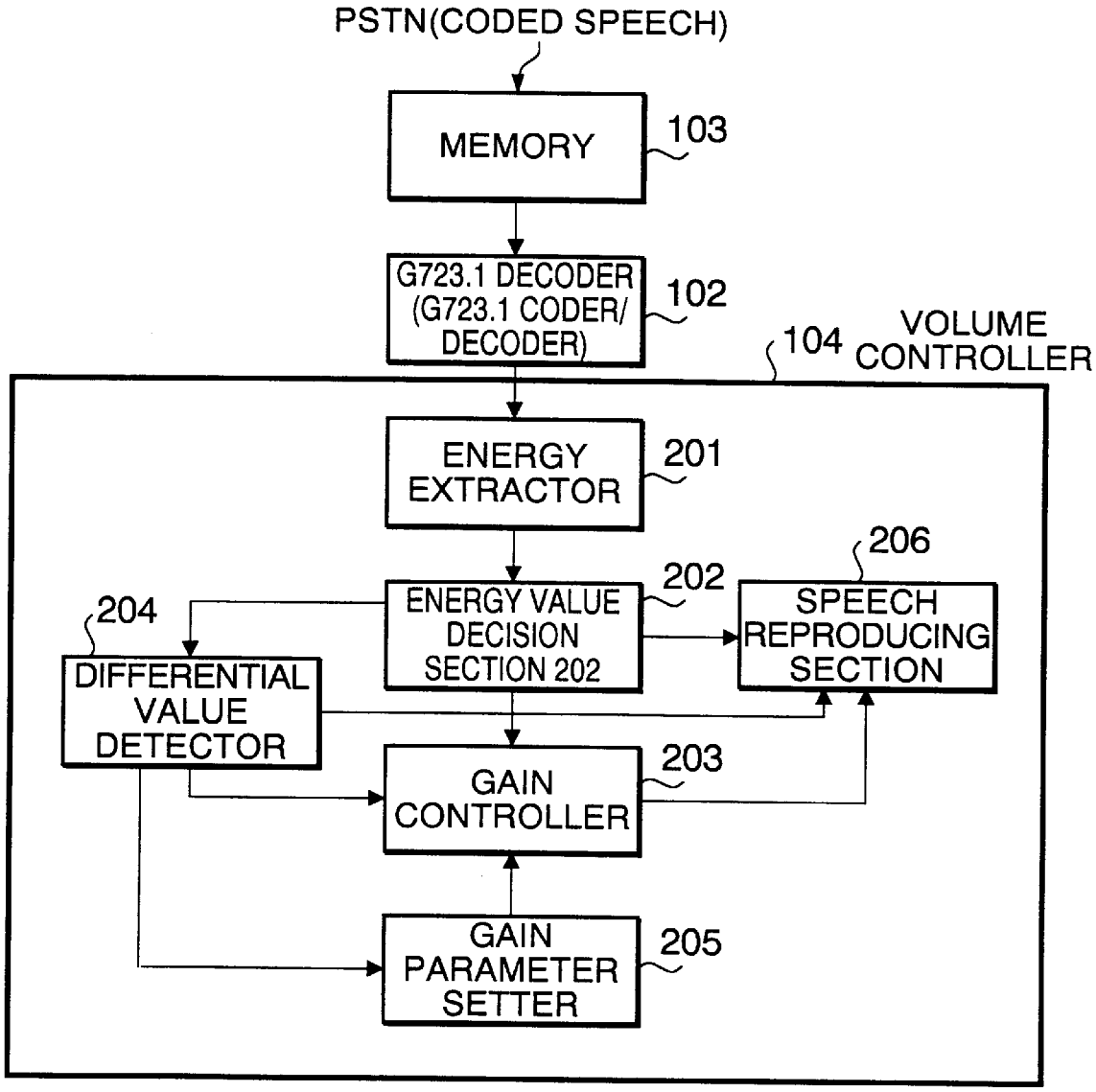
FIG. 3 is a functional block diagram of an auto volume controller according to the above embodiment.

An auto volume control is explained below with reference to the drawing. FIG. 3 is a functional block diagram of auto volume controller of a speech decoding apparatus according to this embodiment.

Digital data (LSP information, pitch information and excitation parameter information) coded by Recommendation G723.1 is received from a telephone line and stored in memory 103.

When the speech signal is reproduced, G723.1 decoder 102 decodes the speech signal to output auto volume controller 104 as a reproduced speech signal. Energy extractor 201 extracts an energy value corresponding to the excitation index of the excitation parameter (Mamp) from an index table. This index table has the same contents with the index table installed in excitation parameter generator 1107 in the coding side. Excitation parameter (Mamp) representing the energy of the excited signal is computed in accordance with Recommendation G723.1 at the coding.

Energy value decision section 202 decides whether the energy value correspond to the excitation parameter (Mamp) is within a predetermined range.

When energy value decision section 202 decides the energy value is within the predetermined range, gain controller 203 performs a gain control of the decoded speech signal using a parameter set in gain parameter setter 205. Speech reproducing section 206 output the sound (voice) subjected to the gain control.

Differential value detector 204 detects the differential value of energies between excitation parameter neighboring sub-frames on a subframe-by-subframe basis, and decides that the speech signal is a noise when the differential value is within a predetermined range. At that time, differential value detector 204 controls gain controller 203 not to perform the gain control.

The operation of the coded speech decoding apparatus configured as described above is explained with reference to FIGS. 4, 5, 10 and 11.

In a basic operation, the gain control is performed in order to approximate the calculated value (Ener×AGain) to a predetermined target value when energy (Ener) generated from excitation parameter (Mamp) is within a predetermined range. The processing is explained in detail using FIG. 4.

Processing units of speech coding in ITU-T Recommendation G723.1 are a frame of 30 msec and a subframe of 7.5 msec that is one-fourth of the frame. The following processing is performed on a subframe (7.5 msec) basis.

In ST 301, energy (Ener) is computed according to the equation 1 where energy (Ener) is an energy of the excited signal corresponding to the excitation index that is one of parameters represented according to ITU-T Recommendation G723.1.

$$\mathrm{Ener}_{n+1}=\mathrm{Mamp}_{n+1}+39/40\ \mathrm{Ener} \tag{1}$$

In addition, n indicates the number of sub-frames and Mamp is excitation parameter (energy) corresponding to the excited signal in a computation object sub-frame. And 39/40 in the equation (1) indicates a corrected value when a sum of energy (Ener) of forty subframes is computed in an IIR filter. Ordinary, when the sum of energy (Ener) of forty subframes is computed, each Ener of 1st to 40th subframes are stored in, for example, a memory, then the sum of those subframes is computed, further a sum of 2nd to 41st first subframes is computed in processing the next subframe. At this point, it is possible to compute the sum of 2nd to 41st subframes by deleting the 1st subframe and adding the 41st subframe.

However, since this calculation method intrudes a large amount of computations, the computations are performed currently using an IIR type filter. 39/40 in the IIR type filter is a coefficient to thin values to delete the 1st subframe at this point, thereby allowing computing easily of a sum of data at a predetermined interval.

In the case of a small number of subframes to be added (for example, 20 subframes and 19/20 as a coefficient), the value of (Ener) increases and decreases drastically. As a result, the energy value sometimes becomes under the lower limit that will be described later in a speech pause, which is not preferable because an On/Off is caused frequently. On the other hand, in the case of a large number of subframes to be added (for example, 60 subframes and 59/60 as a coefficient), a variation of energy (Ener) is so small that it is difficult to set threshold values for the upper and lower limits. Therefore, forty subframes and a coefficient of 39/40 are appropriate at this stage.

Next, in ST302, it is decided whether or not energy (Ener) corresponding to the excitation parameter (Mamp) is within a predetermined range. In the predetermined range, the lower limit indicates a boundary with noise, and the upper limit indicates a value not to overflow digital signals, specifically is the upper limit of a register used in the computation. When (Ener) is within the predetermined range, ST 303 switches on the auto gain controller. When (Ener) is not within the predetermined range, ST 303 switches off the auto gain controller.

When ST 303 switches on the auto gain controller, the gain control is performed in ST304, ST305 and ST307. In ST304, it is decided whether or not the multiplication result of energy (Ener) by gain parameter (AGain) is less than a predetermined target level.

When the multiplication result of energy (Ener) by gain parameter (AGain) is less than the predetermined target level in ST304, the processing shifts to ST305 for performing gain up processing. This target level is within the predetermined range, more than the above-mentioned lower limit and less than the above-mentioned upper limit. Specifically, the appropriate target value may be one-third to one-second the level of the above-mentioned upper limit.

In ST305, gain parameter (AGain) for the correction is determined according to the equations (2), (3) and (4) shown below. The equation (2) indicates anincrement of gain parameter (AGain) (GainUpStep), and determined in order to increase subframe by subframe. The equation (3) is used to determine a decrement of gain parameter (GainDownStep) when the gain parameter is decreased, and has 0 as an initial value. The equation (4) is to compute gain parameter (AGain) by adding a value obtained by dividing the increment (GainUpStep) obtained in the equation 2 by 16 to gain parameter (AGain). As described above, in the gain up processing, gain parameter (AGain) is increased as the subframe processing is increased.

In ST308, the gain parameter (AGain) obtained in the equation (4) is substituted in the equation (8) to compute a final output speech to output. According to the experiments, a=0.2 and b=0.8 are appropriate values in the equation (8). In addition, "a" that is a coefficient for the gain parameter is much smaller than "b" because original data affects an output speech more than the gain parameter.

On the other hand, it is decided that the multiplication result of (Ener) by gain parameter (AGain) is more than the predetermined target level in ST304, the processing shifts to ST307 for the gain down processing. In ST307, gain parameter (AGain) for the correction is determined based on the equations (5), (6) and (7).

In the equation (5), the increment value (GainUpStep) used in increasing the value is hold. The equation (6) is used to determine a decrement value of gain parameter (AGain) and the decrement value is increased subframe by subframe. The equation (7) is to compute gain parameter (AGain) in decreasing the value by subtracting a value obtained by dividing value (GainDownStep) computed in the equation (6) by 64 from gain parameter (AGain). In ST308, the computed gain parameter (AGain) is substituted in the equation (8) to correct data.

These gain parameters (AGain) are set in parameter setter 405 to store.

In addition, energy (Ener) corresponding to the excitation parameter (Mamp) is not within the predetermined range in ST302, the processing shifts to ST306. ST306 switches off the gain control not to perform the correction. However, since an immediate halt of the correction introduces a sense of incongruity, gain parameter (AGain) is decreased to decrease a correction amount gradually using the equation (9), and the processing is repeated subframe by subframe until the gain parameter becomes 1. At this stage, the decrease value is a predetermined constant. Further, when gain parameter (AGain) becomes less than 1, 1 is still used as gain parameter (AGain) for the processing and then the decreasing processing is finished. In ST 308 the similar processing with the above-mentioned is performed for the correction processing using the gain parameter (AGain) computed at this stage. According to the control, it is possible to gradually decrease a correction amount to shift to a non-correction state, thereby enabling a correction for a speech conformable to listen.

(In increasing)

$$GainUpStep=GainUpStep+1 \quad (2)$$

$$GainDownStep=0 \quad (3)$$

$$AGain_{n+1}=AGain_n+GainUpStep/16 \quad (4)$$

(In decreasing)

$$GainUpStePP=GainUpStep \quad (5)$$

$$GainDownStep=GainDownStep+1 \quad (6)$$

$$AGain_{n+1}=AGain_n-GainUpStep/64 \quad (7)$$

(In processing correction)

$$Data=Data\ (b+a\times AGain)\ (\text{where } a+b=1) \quad (8)$$

(In halting correction)

$$AGain_{n+1}=AGain_n-\text{decrement value} \quad (9)$$

In addition, the processing has the characteristic that the increasing rate (GainUp) is high when the gain parameter is increased, i.e., the increment is large, and the decreasing rate (GainDown) is low when the gain parameter is decreased, i.e., the decrement is small. According to the characteristic, the gain control starts functioning immediately after a speech signal is input and when a volume level difference between two sides is present, it is possible to instantly increase the lower volume level to the same level as the higher volume so as to reproduce a speech wholly easy to listen.

The next description is given to a gain control method at a voiceless interval between speeches and a noise interval using FIG. 5 to FIG. 8.

In speech signal, there are voiceless interval s and speechless intervals (the data is not a speech) such as noise intervals along with normal speech data. The method of FIG. 4 corrects also a voiceless interval and noise interval. Therefore, in the present invention, it is necessary to detect a voiceless interval and noise interval to control not to perform the correction processing in such intervals.

Figure 6:
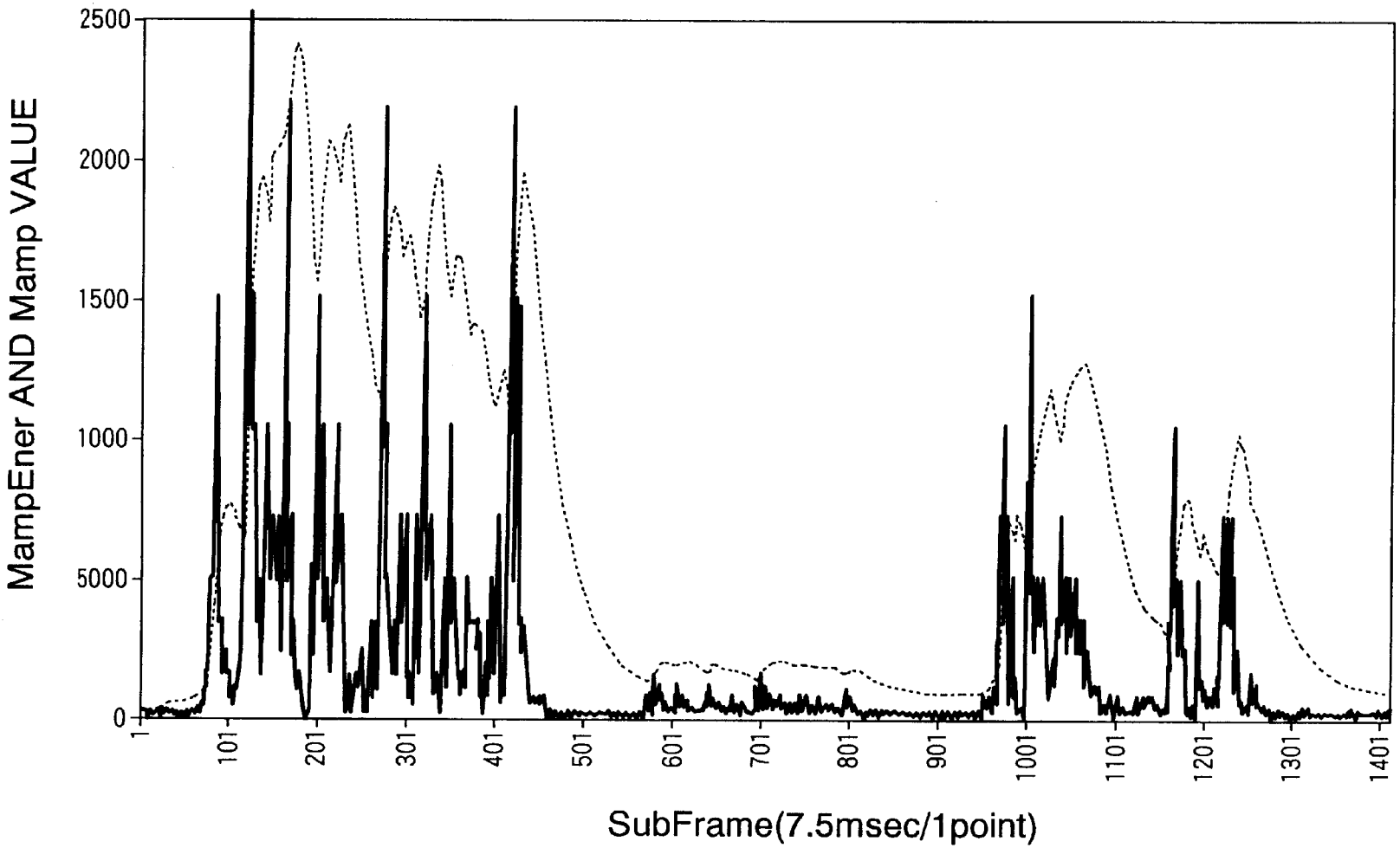
FIG. 6 is a graph illustrating a relationship of excitation parameter (Mamp) and energy (Ener) of the same computed in coding in accordance with G723.1 in the above embodiment.

The first description is given to a method of detecting a voiceless interval and noise interval based on FIG. 6. In FIG. 6, the dotted line indicates (Ener) of (Mamp), and the solid line indicates a variation of excitation parameter (Mamp). It is understood that excitation parameter (Mamp) varies following a large (Ener) part, i.e., where a speech is present. FIG. 6 indicates the relationship of energy (Ener) and excitation parameter (Mamp) of 1st subframe to 1401st subframe. Using this characteristic, a voiceless interval and noise interval are detected by detecting the differential value between neighboring subframes.

Figure 7:
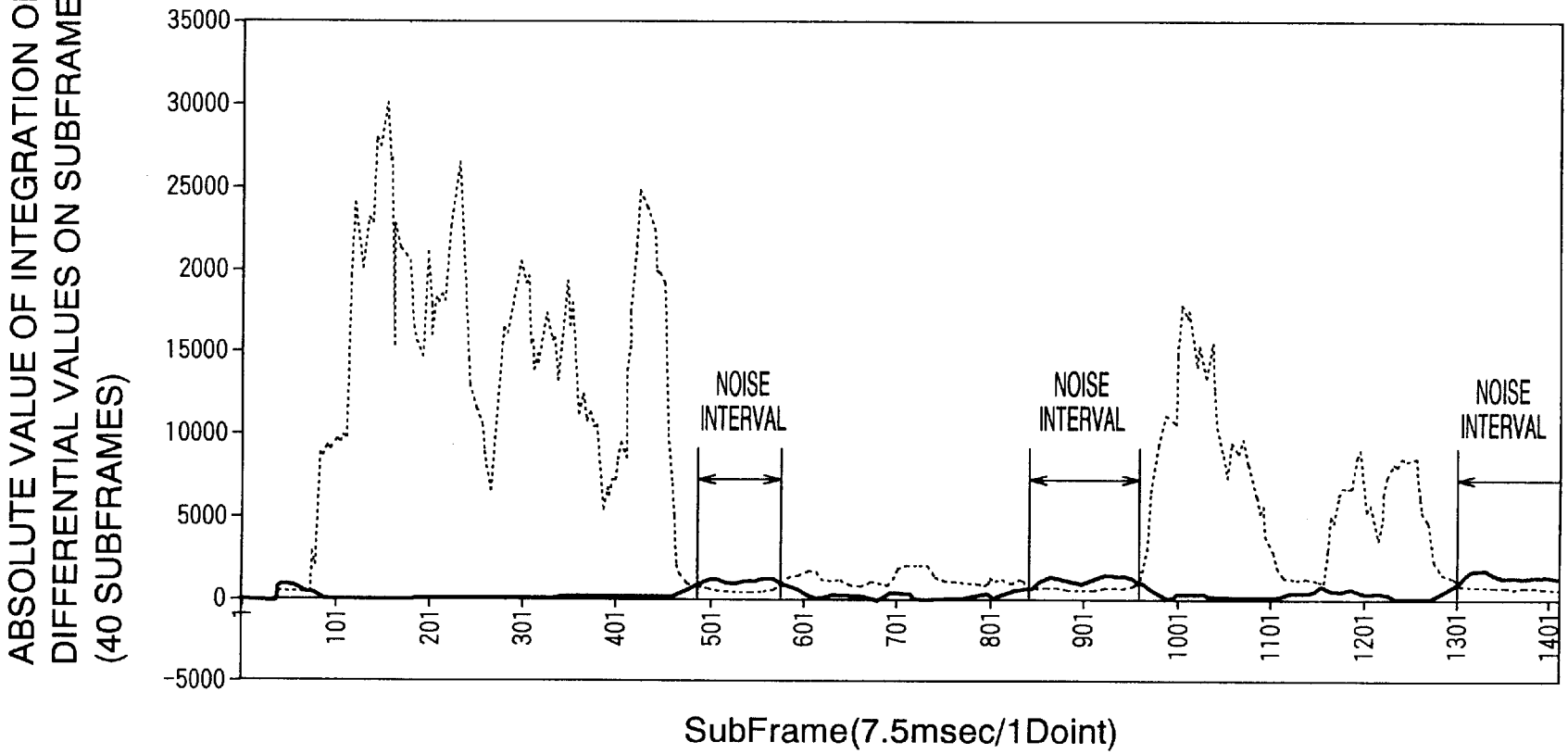
FIG. 7 is a diagram when total Mamp of forty subframes are computed in the above embodiment.
Figure 8:
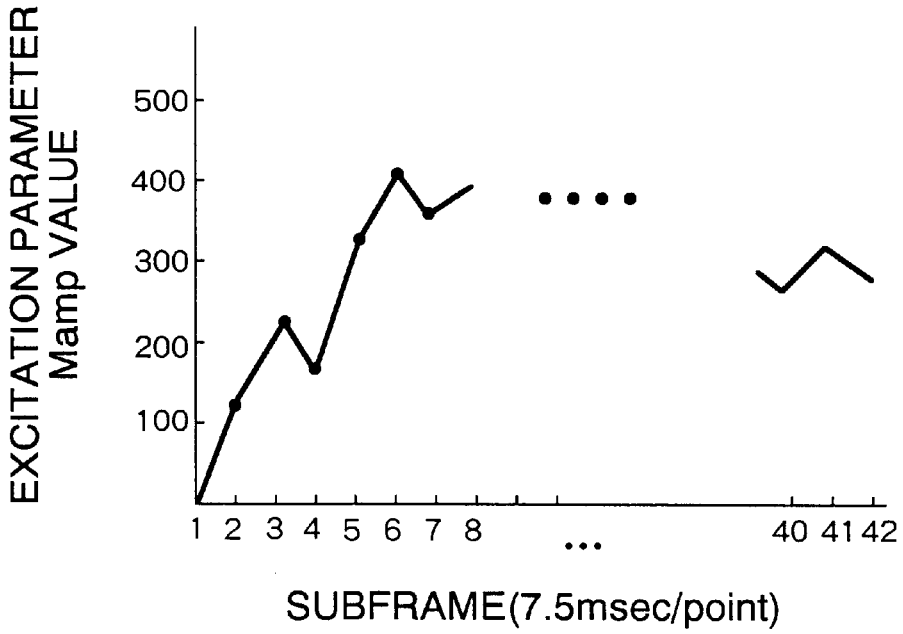
FIG. 8 is an enlarged diagram of a graph illustrating the relationship of excitation parameter (Mamp) and energy (Ener) of the same in the above embodiment.
Figure 9:
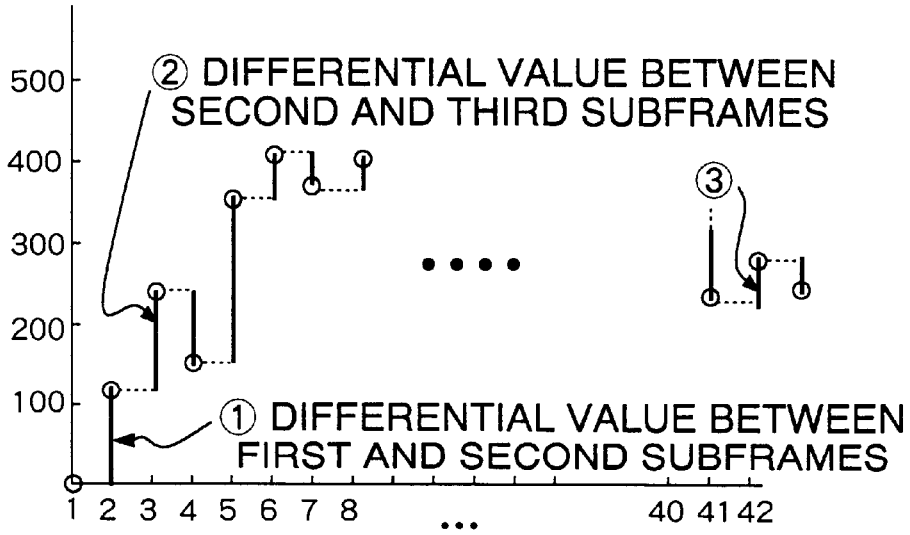
FIG. 9 is a diagram to explain a computation of a differential value between excitation parameter (Mamp) of neighboring subframes on a subframe-by-subframe basis in the above embodiment.

FIG. 8 is a graph of enlarging an interval of 1st subframe to 42nd subframe in FIG. 6. The differential value between neighboring subframes is computed in FIG. 6 and the results are illustrated in FIG. 9. For example, ① indicates the differential value between the 1st subframe and the 2nd subframe that is 1200, where excitation parameter (Mamp) of the 1st subframe is 0 and excitation parameter (Mamp) of the 2nd subframe is 1200. ② indicates the differential value between the 2nd subframe and 3rd subframe in the same way. The same processing is repeated until ③ where the differential value between 40th subframe and 41st subframe is obtained and a sum of the forty differential values is computed. The dotted line in FIG. 7 corresponds to the sum of forty differential values of forty-one subframes just before an object subframe and is indicated for every object frame. Therefore, it is not possible to acquire forty subframes respectively before 1st subframe to 40th subframe, resulting in 0 for each of 1st subframe to 40th subframe.

In FIG. 7, the dotted line indicates a value one-forth that of the sum of differential Mamp values of neighboring forty-one subframes for every subframe. The solid line indicates the sum of the differential value between neighboring subframes that is less than 8 over a forty-one subframes interval. The dotted line indicates the one-forth level to easily compare with the differential value that is less than 8.

At this point, when the condition of the equation (10) is satisfied over several times (several subframes) in row, the data is decided as a voiceless interval or noise interval. Because excitation parameter Mamp of noise or voiceless sound does not vary so much and the differential value at the noise or voiceless interval is usually less than 8. Therefore, the sum of differential values of forty-one subframes just before the object subframe that are less 8 becomes relatively high.

On the other hand, excitation parameter (Mamp) of a normal speech varies much and the differential value at the speech interval is usually not less than 8. Therefore the sum of the differential values that are less than 8 becomes relatively low. Using this phenomenon, the data is decided as a noise when the sum of differential values of forty-one subframes that are less 8 is relatively high.

It is known from the experimental result that one-forth value of the sum of differential values of forty-one subframes just before the object subframe is appropriate for the relatively high value. It may be necessary to satisfy the condition several times in row to prevent misrecognition. In addition, the condition that the differential value is less than 8 and one-forth of the sum is obtained from the experiment as an appropriate condition, however it is possible to change the condition properly, in detail, the number of subframes for the differential value, slice level, or 8 as a boundary differential value.

In addition, the decision whether a noise interval is switched to a speech interval should be performed instantly in order to perform a correction on a speech interval instantly.

$$\text{sum of all differential values}/4 \leqq \text{sum of differential values less than 8.} \quad (10)$$

Figure 4:
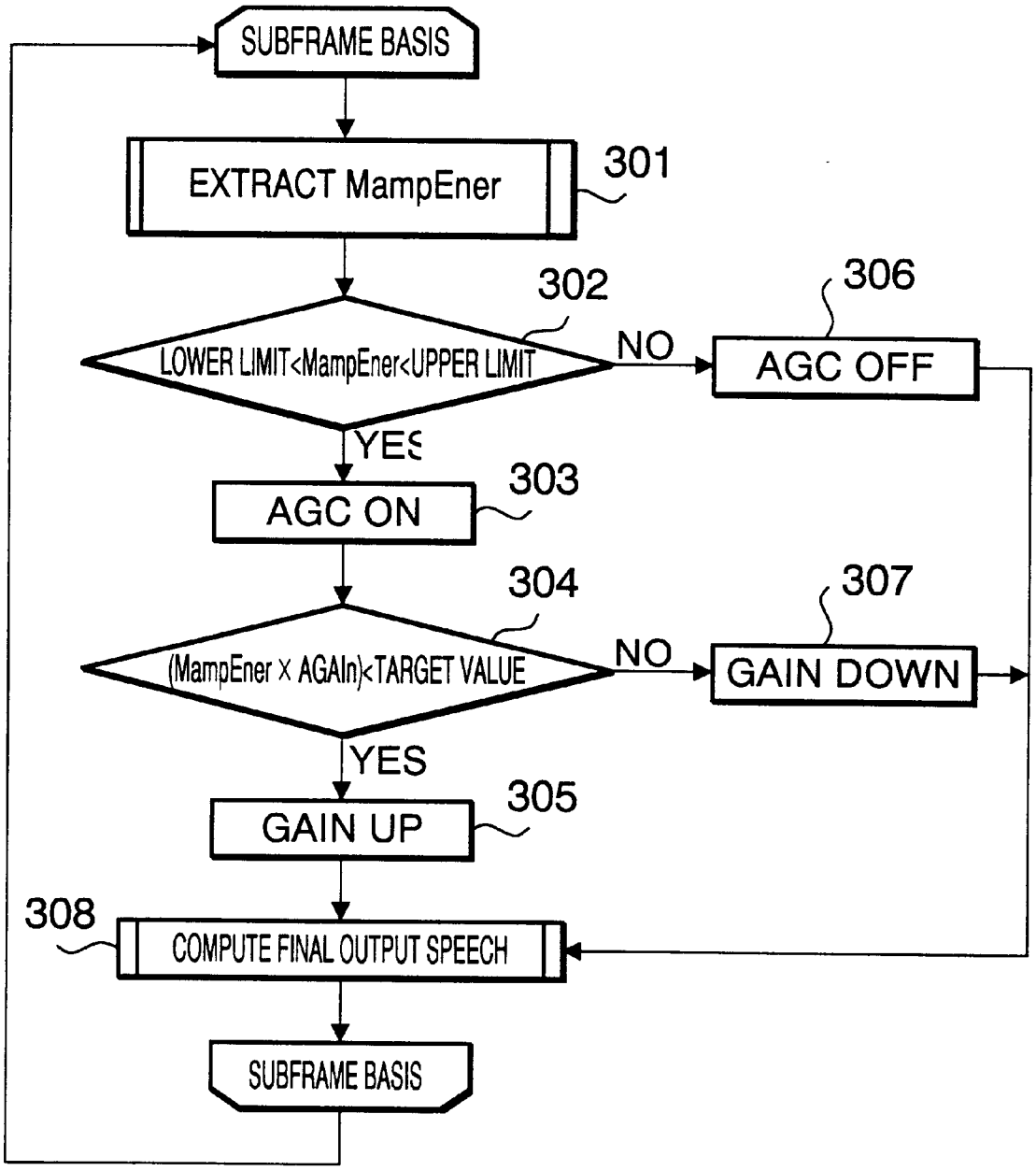
FIG. 4 is a flowchart illustrating a state of the auto volume controller according to the above embodiment.
Figure 5:
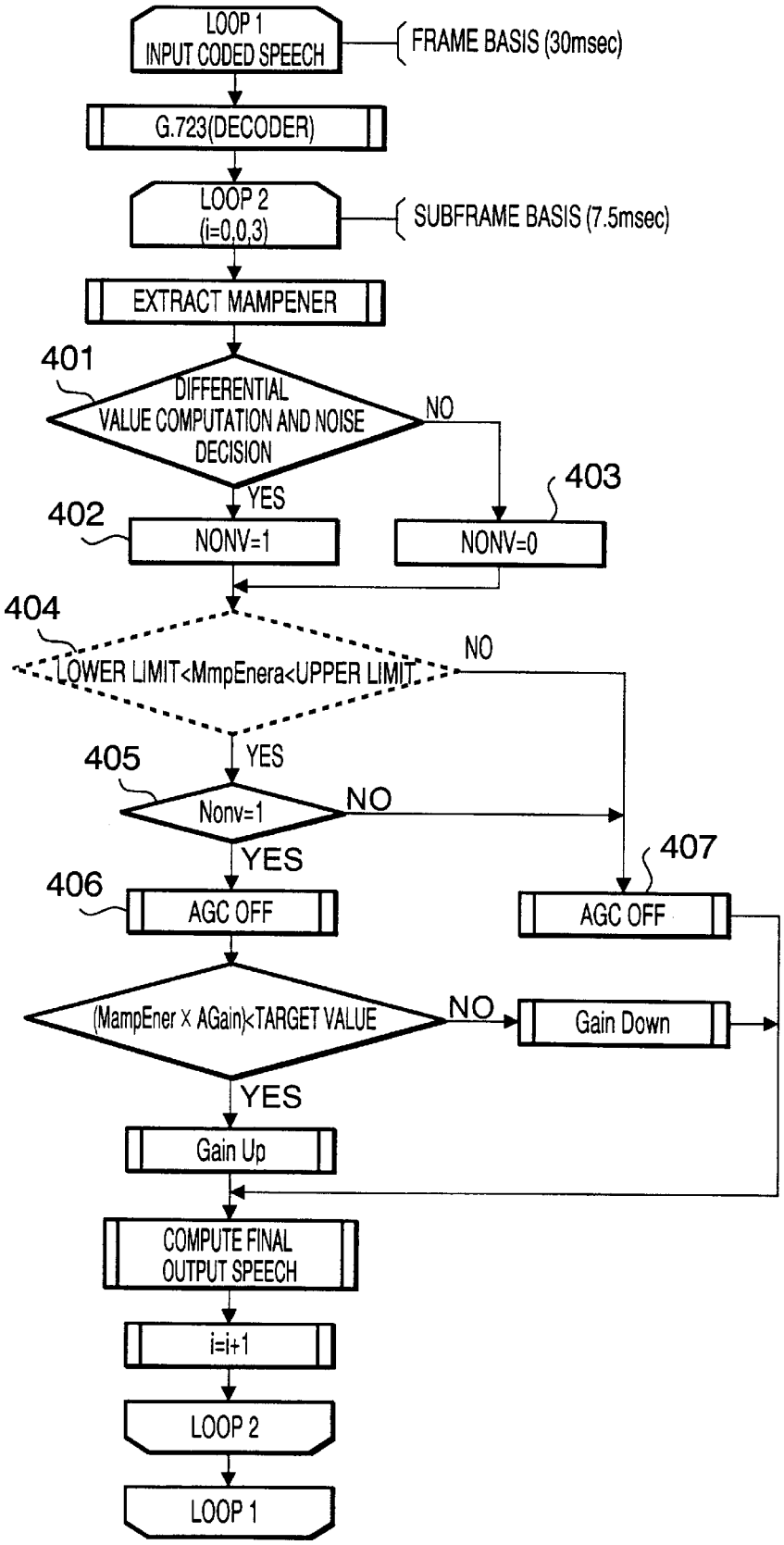
FIG. 5 is a flowchart illustrating a state of the auto volume controller at a noise interval according to the above embodiment.

The following detailed description is given to the correction processing at a voiceless interval or noise interval based on a flow diagram in FIG. 5. With respect to excitation parameter (Mamp), the voiceless interval and noise interval has the same meaning. In addition, the same processing as FIG. 4 is omitted in the following.

In ST401, after (Ener) is extracted, it is decided whether or not the data is a voiceless interval or noise interval using the above-mentioned method. When it is decided that the data is not a voiceless interval or noise interval according to the differential value, the processing shifts to ST402 and flag (Nonv) is set as Nonv=1. When it is decided that the data is a voiceless interval or noise interval according to the differential value control, the processing shifts to ST403 and flag (Nonv) is set as Nonv=0.

In ST404, it is decided whether or not (Ener) is within a predetermined range. When (Ener) is within a predetermined range, the processing shifts to ST405.

In ST405, it is decided whether or not flag (Nonv) that is set in ST402 or ST 03 is 1 (Nonv=1).

When it is decided that Nonv=1 in ST405, the processing shifts to ST406 in order to perform the gain control. When it is decided that (Ener) is not within the predetermined range in ST404 and it is decided that Nonv=0 in ST405, the processing shifts to ST407 in order not to perform the gain control.

The following processing is performed in the same way as FIG. 4, i.e., gain parameter (AGain) is increased or decreased to close to the target value, which is repeated for every subframe.

As described above, it is possible to detect a voiceless interval or noise interval by performing processing by the differential value decision using a variation of excitation parameter (Mamp) that is one of speech characteristics. It is thereby possible not to perform correction processing at a voiceless interval and noise interval, enabling an output speech having no sense of incongruity without increasing noise and a reproduction of a speech easy to listen.

Figure 10:
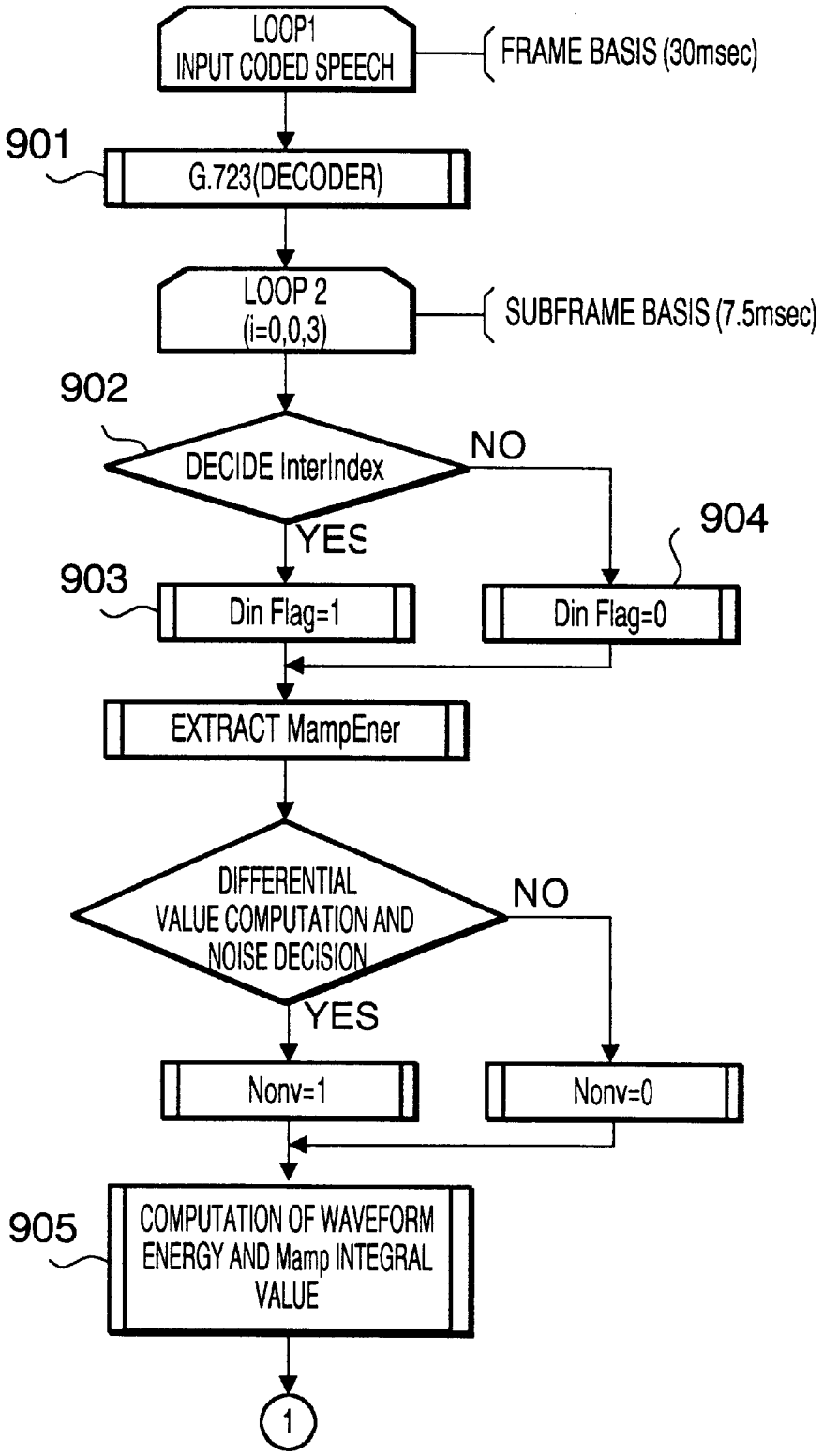
FIG. 10 is a first half of a diagram illustrating a state of the auto volume control in detecting a single frequency signal in the above embodiment.
Figure 11:
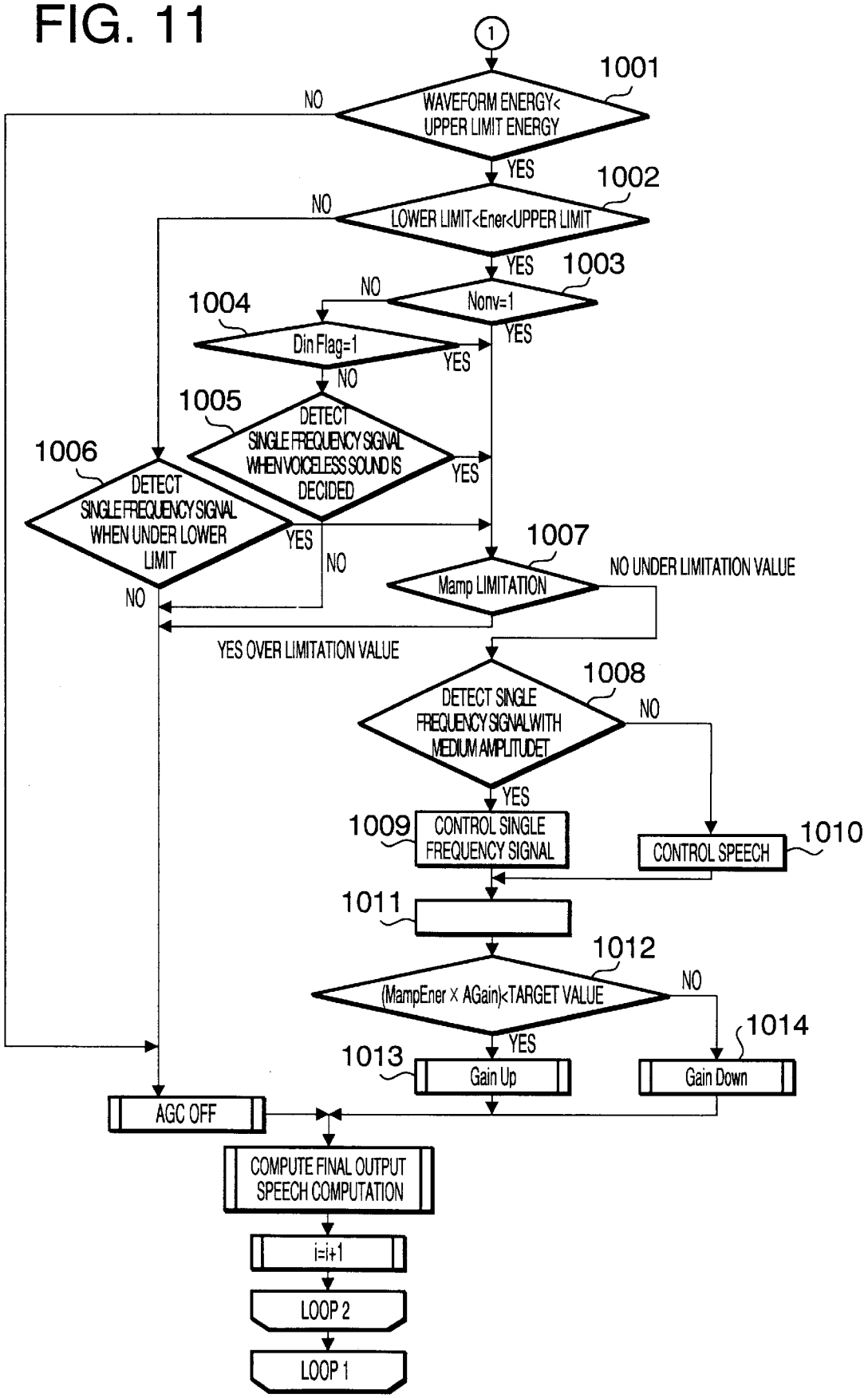
FIG. 11 is a latter half of the diagram illustrating the state of the auto volume control in detecting a single frequency signal in the above embodiment.

The following description is given to the processing for handling PB tone or a single frequency signal as speech signal based on FIG. 10 and FIG. 11. Such signal is usually not handled, however by a wrong operation such as pushing down the push button by an operator, PB tone is sometimes transmitted. In this case, PB tone is also subjected to the auto volume control, resulting in a speech having a sense of incongruity.

Specifically, in parameters of coded information, the PB tone and a single frequency signal depend on pitch parameter that is information indicative of periodicity more than excitation parameter (Mamp) information. Accordingly, an excess gain correction is performed on the PB tone or the single frequency signal having a large amplitude because low (Ener) is obtained.

On the other hand, when a variation of excitation parameter (Mamp) is small, the problem that the data is decided as a noise interval according to the above-mentioned differential value decision processing emerges. As a result, AGC correction is not performed normally on only the single frequency signal but also on the PB tone.

The following description is given to the processing of the auto volume control for PB tone and a single frequency signal based on a flow diagram in FIG. 10 and FIG. 11.

The first description is given with reference to the first half of the flow diagram in FIG. 10.

In ST901, speech information coded in accordance with ITU-T Recommendation G723.1 is decoded.

In ST902, it is decided whether or not index (InterIndx) indicates a voiced sound or voiceless sound. Based on the decision, the processing shifts to either of ST903 or ST904. Index (InterIndx) is generated as pitch information along with pitch length in coding in accordance with ITU-T Recommendation G723.1, and the information indicative of voiced sound or voiceless sound.

When it is a voiceless sound, the processing shifts to ST903 where Din_Flag=1. When it is a voiced sound, the processing shifts to ST904 where Din_Flag=0.

Then in the same way as FIG. 5, (Ener) is extracted, and it is decided whether or not the data is a noise interval by the differential value computation. When it is not the noise interval, Nonv=1 is set. When it is the noise interval, Nonv=0 is set.

In ST905, speech waveform energy (VCEner) is computed. The speech waveform energy (VCEner) is the total energy of four subframes (30 ms) and computed by the equation (11). The sum (MampIntgral) of excitation parameter (Mamp) of four subframes (30 ms) is computed using the equation (12). In addition, the waveform energy represents the total energy of sixty samples of speech waveform in a subframe to be computed.

$$\mathrm{VCEner}_{n+1}=\text{waveform energy}+\tfrac{3}{4}\,\mathrm{VCEner}_n \tag{11}$$

$$MampIntgral=\sum_{n=0}^{3} Mamp_n \tag{12}$$

¾ in the equation (11) is a coefficient in an IIR type filter for sequentially computing energies of four subframes for every subframe. Four subframes are appropriate to confirm the decision of noise interval. It becomes difficult to decided whether the interval is noise when the smaller number than four is used. The computation amount becomes great when the larger number than four is used. Therefore four is the appropriate value.

The following description is given based on a latter half of a flow diagram in FIG. 11.

In ST1001, it is decided whether or not speech waveform energy (VCEner) is more than a predetermined upper limit. When waveform energy (VCEner) is more than the predetermined upper limit, the correction processing is controlled not to be performed in order to prevent the overflow.

When waveform energy (VCEner) is less than the predetermined upper limit, the processing shifts to ST1002. In ST1002, it is decided whether or not (Ener) is within a predetermined range. When it is decided that energy (Ener) is within the predetermined range, the processing shifts to ST1003. In ST1003, it is decided whether or not the flag that is used to decide a voiced sound or voiceless sound indicates Nonv=1.

When Nonv is not 1 in ST1003, i.e., the data is a noise interval, the processing shifts to ST1004. In ST1004 examines flag (Din_Flag) defined in ST903 and ST904. When Din_Flag=0, the processing shifts to ST1005.

In ST1005, it is decided whether or not the data is PB tone or a single frequency signal. When speech waveform energy (VCEner) is more than the predetermined value and excitation parameter (Mamp) is less than the predetermined value, in other words, when (MampIntgral) is within the predetermined range and speech waveform energy (VCEner) is more than the predetermined value, the data is recognized as the PB tone or single frequency signal, then the processing shifts to ST1007. Otherwise the control is performed to switch off AGC in order not to perform the correction processing.

According to the above processing, it is possible to detect PB tone or a single frequency signal that was once decided as a noise by the differential value decision processing. Therefore it is further possible to perform the gain control on the PB tone or single frequency signal that has been not conventionally subjected to the gain control, enabling a reproduction of a speech easy to listen.

In addition, when it is decided that (Ener) is not within the predetermined range in ST1002, the processing shifts to ST1006. In ST1006, it is decided whether or not (Ener) is less than the lower limit in the predetermined range and whether or not the data is the PB tone or single frequency signal. The detection of the PB tone or single frequency speech is performed in the same way as the above-mentioned processing. In other words, when speech waveform energy (VCEner) is more than the predetermined value and excitation parameter (Mamp) is less than the predetermined value, the data is recognized as the PB tone or single frequency signal, and then the processing shifts to ST1007.

In addition, the predetermined value at this point is larger than the previous one. When the data is not recognized as the PB tone or single frequency signal, or (Ener) is more than the upper limit, the data is recognized as noise and thecontrol is performed to switch off AGC in order not to perform the correction processing. According to the above processing, it is possible to detect PB tone or a single frequency signal whose (Ener) is less than the lower limit.

In ST1007, it is decided whether or not (Mamp) value is within a limitation when the speech data is decided as the PB tone or single frequency signal or decided as a speech. At this point, it is decided whether or not (Mamp) is more than the predetermined value and AGC is necessary. The processing shifts to ST1008 when AGC is necessary, while AGC is switched off when AGC is not necessary.

In ST1008, it is decided whether or not the speech data is the PB tone or single frequency signal that has the risk to overflow, using speech waveform energy (VCEner) and the sum (MampIntgral) of (Mamp) of four subframes computed in ST905. In other words, it is decided the speech data has the risk to overflow when the data is subjected to the gain control because the data amplitude is a medium level. When speech waveform energy (VCEner) of the data is more than a predetermined value and the sum (MampIntgral) of the data is less than a predetermined value, it is decided that the data is the PB tone or single frequency signal with the medium amplitude, and the processing shifts to ST1009.

In ST1009, the control is performed for the PB tone or single frequency signal. Specifically, (TagFlag) of the data that is used in determining the target value is increased.

In ST1010, (TagFlag) is decreased. In this case, the data is decided as the PB tone or single frequency signal with small amplitude.

In ST1011, the target value is set using (TagFlag) set in ST1009 or ST1010 in the equation (13). "□" in the equation (13) is a parameter to adjust a convergence rate to the target value. In addition, (TagFlag) is set more than zero and less than an arbitrary number, i.e., 0≦TagFlag≦arbitrary number so that the target value is not less than the lower limit by □.

According to the above processing, it is possible to avoid the over flow with respect to the PB tone or single frequency signal by enabling a target value to be variable.

$$\text{Target value}=\text{Target value}-\square\times\text{TagFlag}/4 \tag{13}$$

In ST1012, it is decided that the multiplication of MampEner by gain parameter AGain is more or less than the target value, then the processing shifts to AT 1013 or AT 1014.

In ST1013, the GainUp processing is performed. At this point, with respect to the subframe subjected to the speech control processing in ST1010, the gain parameter AGain is computed using the equations (2), (3) and (4). On the other hand, with respect to the subframe subjected to the single frequency control signal processing including PB tone control processing in ST1009, the gain parameter (AGain) is computed using the equations (2), (3) and (14).

$$\text{AGain}_{n+1}=\text{AGain}_n+\text{GainUpStep}/6\ 4 \tag{14}$$

The equation (14) is used in order to prevent PB tone or a single frequency signal having a sense of incongruity from being reproduced. Because the AGC processing with sharp setup to hold the speech quality introduces the reproduced PB tone or single frequency signal having a sense of incongruity since a waveform variation of the PB tone or single frequency signal is less than that of a speech. The (GainUp) processing with the same characteristic as the (GainDown) thus enables the AGC processing for the PB tone or single frequency signal having no sense of incongruity.

In ST1014, the (GainDown) processing is performed and to compute gain parameter AGain using the equations (5), (6) and (7).

The computation processing is performed to obtain a final speech using gain parameter (AGain) computed in ST1013 and ST1014 and the corrected speech is output.

It is thus possible not to recognize PB tone or a single frequency signal as noise so as to perform the proper gain control, thereby enabling a speech to be properly corrected and a reproduction of the speech easy to listen.

As described above, the present invention enables a gain control to be performed with high accuracy and a reproduction of the speech easy to listen in decoding the coded speech with excitation parameter in accordance with ITU-T Recommendation G723.1 and the CELP system.

The present invention is not limited to the above described embodiments, and various variations and modifications may be possible without departing from the scope of the present invention.

This application is based on the Japanese Patent Application No.HEI 10-88175 filed on Mar. 16, 1998, entire content of which is expressly incorporated by reference herein.

What is claimed is:

1. A speech decoding apparatus comprising:

a decoder that decodes a speech signal coded by CELP coding so as to include at least an excitation parameter, pitch information and LPC information;

a controller that controls an output speech volume of the decoded speech signal according to a gain parameter; and a correction unit that corrects the gain parameter according to an energy of the excitation parameter.

2. The speech decoding apparatus according to claim 1, wherein said controller controls the output speech volume according to said gain parameter when the energy of said excitation parameter is within a predetermined range.

3. The speech decoding apparatus according to claim 2, wherein said controller controls the output speech volume of the decoded speech signal for every subframe, and said correction unit increases or decreases the gain parameter so that a result of multiplication of the energy of the excitation parameter by the gain parameter approximately becomes a target value that is arbitrarily set within said predetermined range.

4. The speech decoding apparatus according to claim 3, wherein said apparatus corrects said target value to a smaller value when the speech signal has a periodicity.

5. The speech decoding apparatus according to claim 1, wherein said correction unit increases the gain parameter with a large increment when increasing the gain parameter, and decreases the gain parameter with a small decrement when decreasing the gain parameter.

6. The speech decoding apparatus according to claim 1, wherein said correction unit decreases the gain parameter gradually on a subframe-by-subframe basis when a gain control is halted.

7. The speech decoding apparatus according to claim 1, wherein said apparatus obtains the energy of the excitation parameter by making said excitation parameter pass though an IIR type filter.

8. The speech decoding apparatus according to claim 1, wherein the output speech volume of the speech signal is determined based on the following equation;

output speech volume after correction=output speech volume before correction (0.8+0.2×gain parameter).

9. The speech decoding apparatus according to claim 1, further comprising:

a noise recognition unit that recognizes a noise period in the speech signal, and wherein said controller does not control the output speech volume at the noise period.

10. The speech decoding apparatus according to claim 9, wherein said noise recognition unit comprising:

a differential value detector that detects a differential value between energies of excitation parameters of adjacent subframes;

a system that obtains a first sum by adding the detected differential values for a plurality of previous subframes;

a system that obtains a division value by dividing the first sum by a predetermined number;

a system that obtains a second sum by adding the detected differential values that are less than a predetermined value for the plurality of previous subframes; and a system that recognizes a noise period by detecting a subframe whose second sum is more than the division value.

11. The speech decoding apparatus according to claim 9, wherein said noise recognition unit recognizes a change from a speech period to a noise period using a plurality of subframes, and recognizes a change from the noise period to the speech period using a single subframe.

12. The speech decoding apparatus according to claim 1, further comprising:

a recognition system that recognizes whether the speech signal has periodicity; and the correction unit performing a gain control appropriate for a speech signal with periodicity when it is recognized that the speech signal has periodicity.

13. The speech decoding apparatus according to claim 12, wherein said recognition system recognizes one of a PB tone and a single frequency signal when a waveform energy of a speech waveform of the speech signal is more than a predetermined value and the energy of the excitation parameter is within a predetermined range.

14. The speech decoding apparatus according to claim 12, further comprising:

a storage unit that stores a plurality of equations indicative of characteristic curves of gain parameter, and said correction unit correcting the gain parameter according to a characteristic curve that increases gradually when said recognition system recognizes the speech signal as one of a PB tone and a single frequency signal, and the correction unit correcting the gain parameter according to a characteristic curve that increases rapidly when said recognition system recognizes the speech signal as an ordinary speech.

15. The speech decoding apparatus according to claim 1, wherein the correction unit calculates the energy of the excitation parameter in a (n+1) subframe by the following equation:

$$Ener(n+1)=Mamp(n+1)+((X-1)/X)\times Ener(n),$$

wherein Ener represents the energy of the excitation parameter, Mamp represents an amount of the excitation parameter, and X is an arbitrary number.

16. A speech decoding method comprising:

decoding a speech signal coded by CELP coding so as to include at least an excitation parameter, pitch information and LPC information;

computing an energy of the excitation parameter; and correcting an output speech volume of the decoded speech signal based on a predetermined gain parameter when the computed energy of the excitation parameter is within a predetermined range.

17. A speech decoding apparatus comprising:

a decoder that decodes a speech signal coded by CELP coding so as to include at least an excitation parameter, pitch information and LPC information;

an energy computing system that computes an energy of the excitation parameter; and a gain controller that does not perform a gain control of an output speech volume of the speech signal when the computed energy of the excitation parameter is not within a predetermined range, and that performs the gain control of an output speech volume of the speech signal with a gain amount that is corrected according to a predetermined gain parameter when the computed energy of the excitation parameter is within the predetermined range.

* * * * *